US006488018B2

(12) United States Patent
Hulm

(10) Patent No.: US 6,488,018 B2
(45) **Date of Patent: *Dec. 3, 2002**

(54) ARROW HOLDING DEVICE

(76) Inventor: Donald E. Hulm, 916 NE. Sixth St., Madison, SD (US) 57042

( * ) Notice: Subject to any disclaimer, the term of this patent is extended or adjusted under 35 U.S.C. 154(b) by 0 days.

This patent is subject to a terminal disclaimer.

(21) Appl. No.: 09/769,214

(22) Filed: Jan. 24, 2001

(65) Prior Publication Data

US 2002/0096162 A1 Jul. 25, 2002

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 3,244,161 A * 4/1966 Jenson ..... 124/44.5 X
3,606,875 A * 9/1971 Carella ..... 124/44.5 X
3,896,782 A * 7/1975 Carella ..... 124/44.5
5,235,958 A * 8/1993 Laffin ..... 124/44.5
5,611,323 A * 3/1997 Townley ..... 124/44.5
5,697,356 A * 12/1997 Chappell ..... 124/44.5

* cited by examiner

*Primary Examiner*—John A. Ricci
(74) *Attorney, Agent, or Firm*—Michael S. Neustel

(57) ABSTRACT

An arrow holding device for retaining an arrow within an arrow support rest until the user is prepared to shoot without affecting the flight of the arrow. The arrow holding device includes a base plate that is attachable to the support rest, a guide arm extending from the base plate, a securing strap attached to the base plate, and a ring member attached to the distal end of the securing strap for removably engaging the guide arm. The securing strap is positioned about the shaft of an arrow and then the ring member is positioned upon the guide arm to prevent movement of the arrow within the support rest. When the user draws the arrow rearwardly the securing strap moves rearwardly until the ring member is pulled from the guide arm thereby releasing the securing strap from about the shaft of the arrow.

20 Claims, 8 Drawing Sheets

Mathews Version

Bodoodle Version

ARROW HOLDING DEVICE

BACKGROUND OF THE INVENTION

1. Field of the Invention

The present invention relates generally to arrow support rests for bows and more specifically it relates to an arrow holding device for retaining an arrow within an arrow support rest until the user is prepared to shoot without affecting the flight of the arrow.

2. Description of the Prior Art

Arrow support rests have been in use for years. Typically, an arrow support rest is comprised of a structure that is attached to the side member of a bow extending below the normal position of the arrow so as to support the arrow in a desired position. Most arrow support rests include a pair of extended prongs that are positioned on opposing sides of the arrow shaft. The user is able to retain the arrow upon the bow without having to physically grasp the arrow during non-usage. The three most popular shoot-through arrow support rests currently on the market are QUIKTUNE, BODOODLE, and GOLDEN KEY FUTURA.

However, a problem occurs when the user moves the bow around which causes the arrow to fall from the support rest. The arrow often times becomes "jammed" between the arrow support rest and the side member of the bow. Other times the arrow simply falls completely from the support rest and bow.

While these devices may be suitable for the particular purpose to which they address, they are not as suitable for retaining an arrow within an arrow support rest until the user is prepared to shoot without affecting the flight of the arrow. Conventional arrow support rests are not designed to effectively retain the arrow within them for extended periods of time until the arrow is released.

In these respects, the arrow holding device according to the present invention substantially departs from the conventional concepts and designs of the prior art, and in so doing provides an apparatus primarily developed for the purpose of retaining an arrow within an arrow support rest until the user is prepared to shoot without affecting the flight of the arrow.

SUMMARY OF THE INVENTION

In view of the foregoing disadvantages inherent in the known types of arrow support rests now present in the prior art, the present invention provides a new arrow holding device construction wherein the same can be utilized for retaining an arrow within an arrow support rest until the user is prepared to shoot without affecting the flight of the arrow.

The general purpose of the present invention, which will be described subsequently in greater detail, is to provide a new arrow holding device that has many of the advantages of the arrow support rests mentioned heretofore and many novel features that result in a new arrow holding device which is not anticipated, rendered obvious, suggested, or even implied by any of the prior art arrow support rests, either alone or in any combination thereof.

To attain this, the present invention generally comprises a base plate that is attachable to the support rest, a guide arm extending from the base plate, a securing strap attached to the base plate, and a ring member attached to the distal end of the securing strap for removably engaging the guide arm. The securing strap is positioned about the shaft of an arrow and then the ring member is positioned upon the guide arm to prevent movement of the arrow within the support rest. When the user draws the arrow rearwardly the securing strap moves rearwardly until the ring member is pulled from the guide arm thereby releasing the securing strap from about the shaft of the arrow.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an arrow holding device that will overcome the shortcomings of the prior art devices.

A second object is to provide an arrow holding device for retaining an arrow within an arrow support rest until the user is prepared to shoot without affecting the flight of the arrow.

Another object is to provide an arrow holding device that may be utilized with various designs of arrow support rests.

An additional object is to provide an arrow holding device that does not interfere with the flight of the arrow.

A further object is to provide an arrow holding device that is able to retain an arrow within a support rest for extended periods of time.

Another object is to provide an arrow holding device that automatically releases the arrow when the arrow is slightly drawn.

A further object is to provide an arrow holding device that allows a bow user to position the bow at various positions including upside down and sideways without the arrow becoming accidentally dislodged from the arrow support rest.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
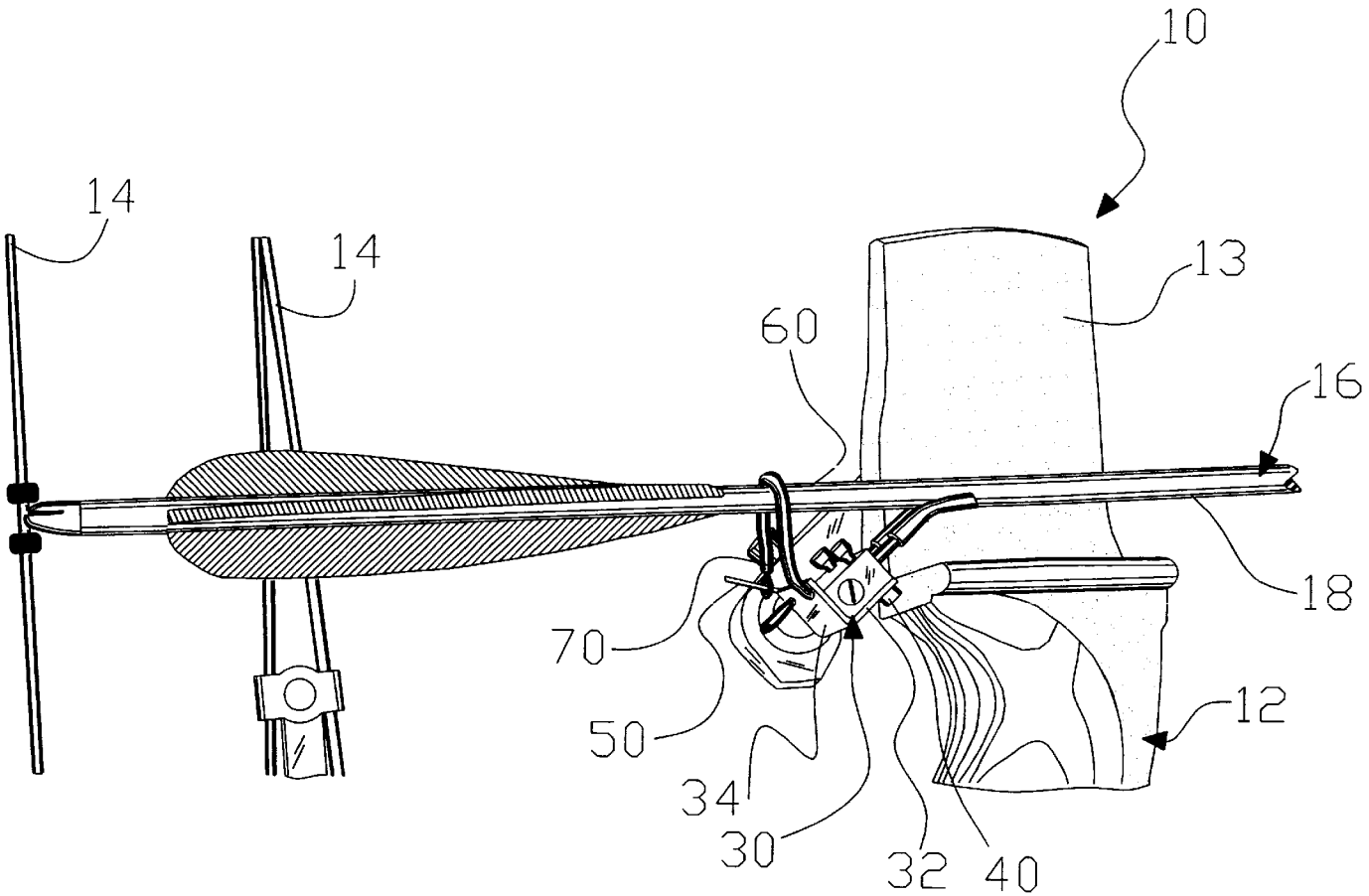
FIG. 1 is an upper perspective view of the present invention attached to an arrow support-rest with the securing strap positioned about the arrow shaft.

Turning now descriptively to the drawings, in which similar reference characters denote similar elements throughout the several views, FIGS. 1 through 8*c* illustrate an arrow holding device 10, which comprises a base plate 30 that is attachable to the support rest 20, a guide arm 50 extending from the base plate 30, a securing strap 50 attached to the base plate 30, and a ring member 70 attached to the distal end of the securing strap 50 for removably engaging the guide arm 50. The securing strap 60 is positioned about the shaft 18 of an arrow and then the ring member 70 is positioned upon the guide arm 50 to prevent movement of the arrow 16 within the support rest 20. When the user draws the arrow 16 rearwardly the securing strap 60 moves rearwardly until the ring member 70 is pulled from the guide arm 50 thereby releasing the securing strap 60 from about the shaft 18 of the arrow 16.

Figure 2:
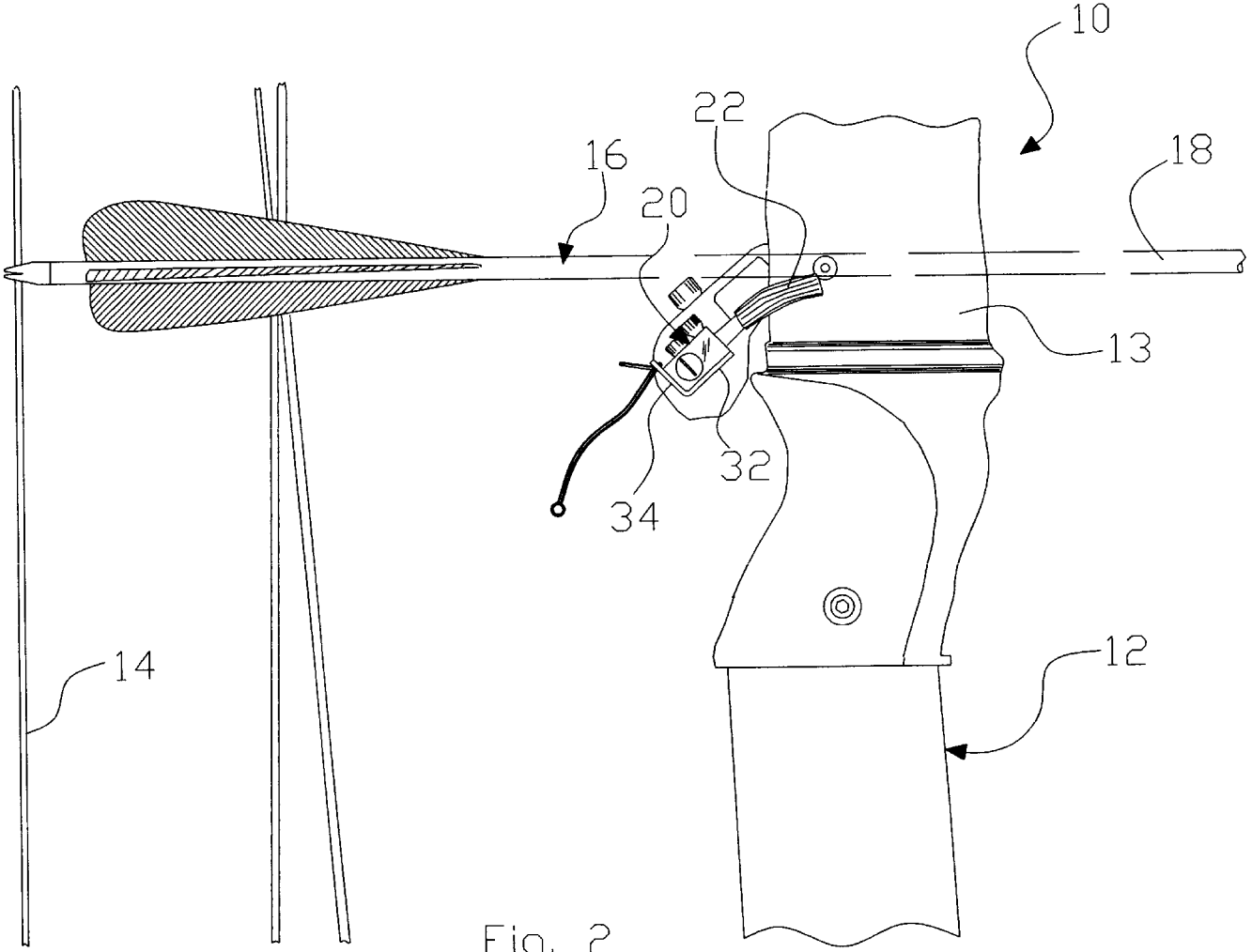
FIG. 2 a side view of the present invention attached to the arrow support rest with the securing strap released.

As shown in FIGS. 1 and 2 of the drawings, a conventional bow 12 has a central side member 13 that the user grasps while holding the bow 12 and wherein the arrow 16 passes by during flight. The bow 12 further includes one or more cables 14 that the arrow 16 is engaged with as is commonly found in straight and compound bows 12.

Figure 3:
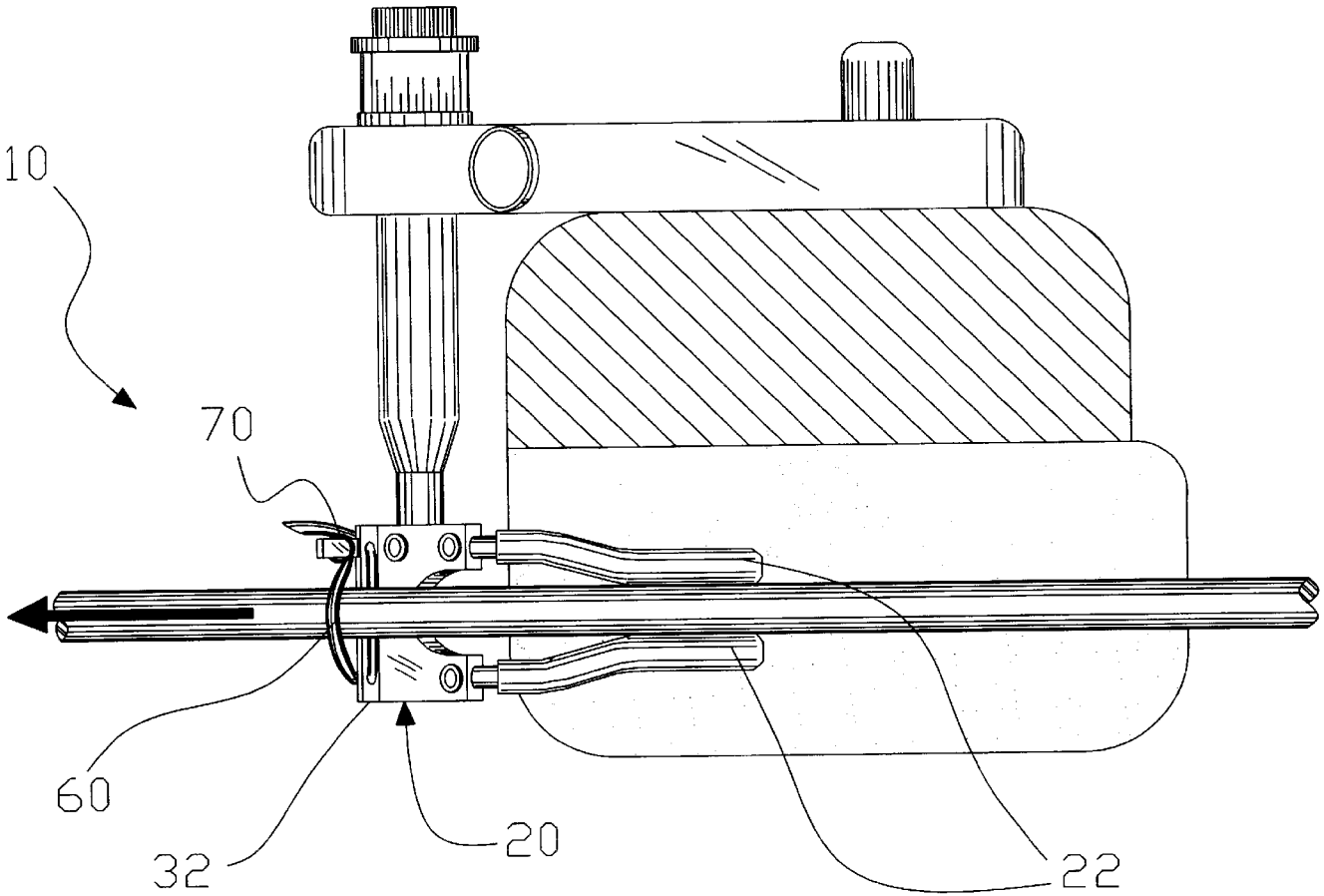
FIG. 3 is a top view of the present invention attached to the arrow support rest with the securing strap positioned about the arrow shaft.
Figure 4:
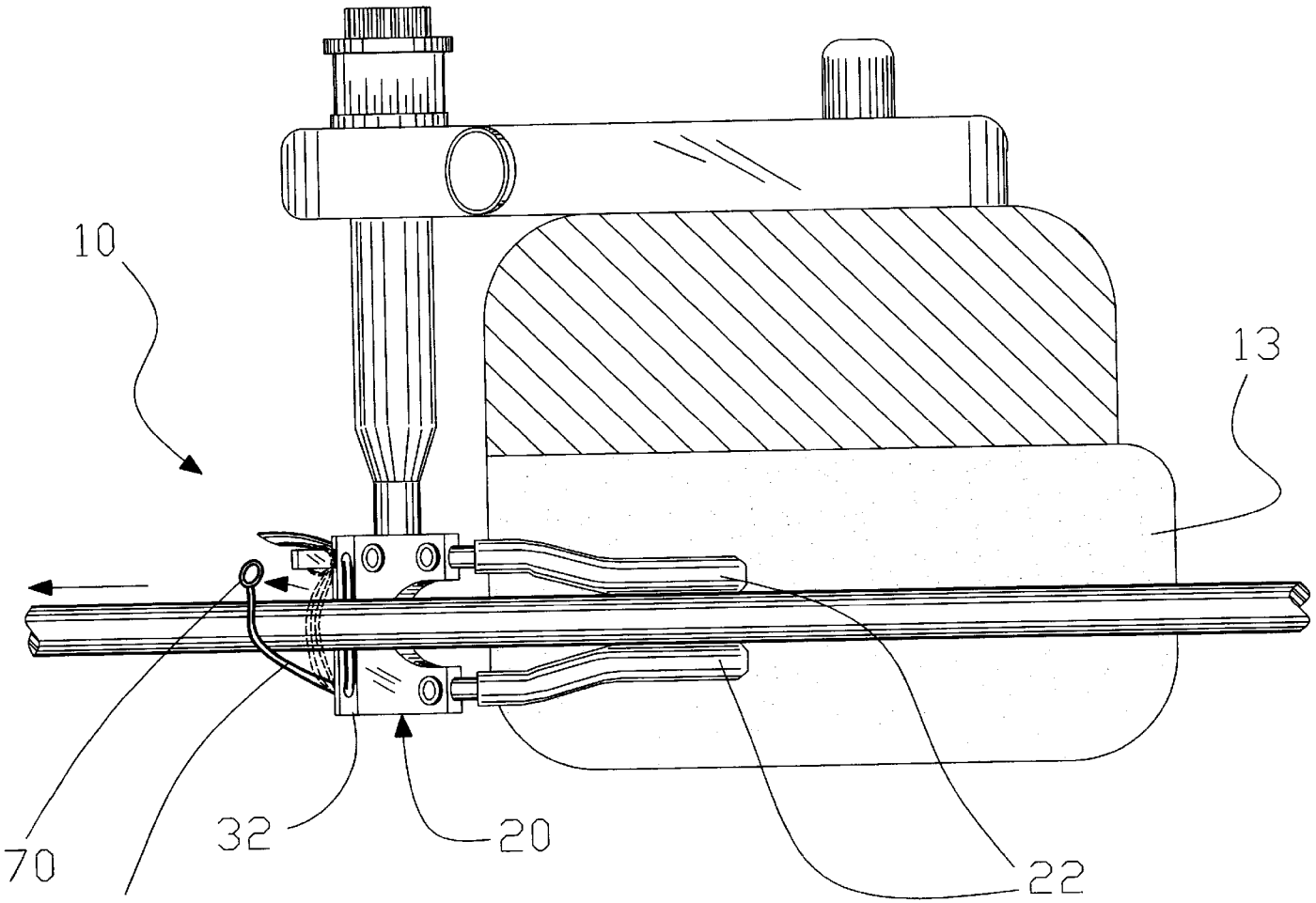
FIG. 4 is a top view of the present invention attached to the arrow support rest with the securing strap partially released from the arrow shaft as the arrow shaft is drawn rearwardly.
Figure 5:
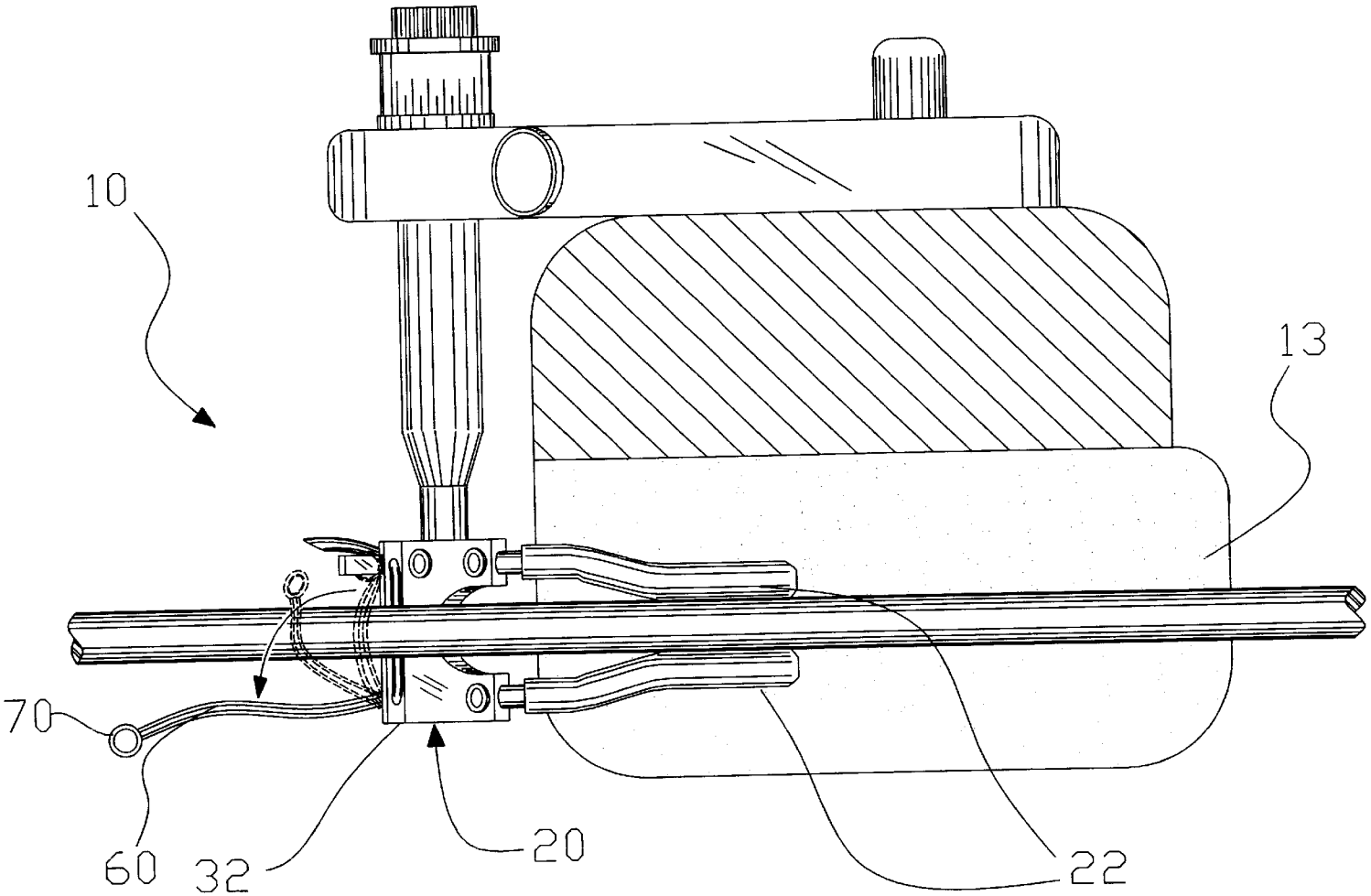
FIG. 5 is a top view of the present invention attached to the arrow support rest with the securing strap fully released from the arrow shaft as the arrow shaft is drawn rearwardly.

In addition, many users of a conventional bow 12 utilize a support rest 20 that is attached to the side member 13 and extends about the bow 12 to support the shaft 18 of the arrow 16 before and during initial flight as shown in FIGS. 1 through 5 of the drawings. A conventional support rest 20 typically includes a pair of extended support arms 22 that are slightly curved as best illustrated in FIGS. 1 and 5 of the drawings. The support arms 22 are formed for supporting the lower portion of the shaft 18 of the arrow 16. As illustrated in FIG. 3 of the drawings, sometimes the arrow 16 falls inwardly toward the side member 13 from the support arms 22 of the support rest 20 when the bow 12 is either bumped or positioned in an inclined, upside down or sideways position.

As shown in FIGS. 1 through 8*c* of the drawings, the present invention includes a base plate 30 that is formed to attach to the main body of the support rest 20. Depending upon the type of support rest 20 that the base plate 30 is being attached to, various configurations may be utilized as can be appreciated. The base plate 30 includes one or more apertures 36 that receive a corresponding number of fasteners 40 wherein the fasteners 40 threadably engage threaded apertures 36 within the body of the support rest 20. The base plate 30 may be constructed of various types of materials including but not limited to metal and plastic.

Figures 6A, 6B, 6C:
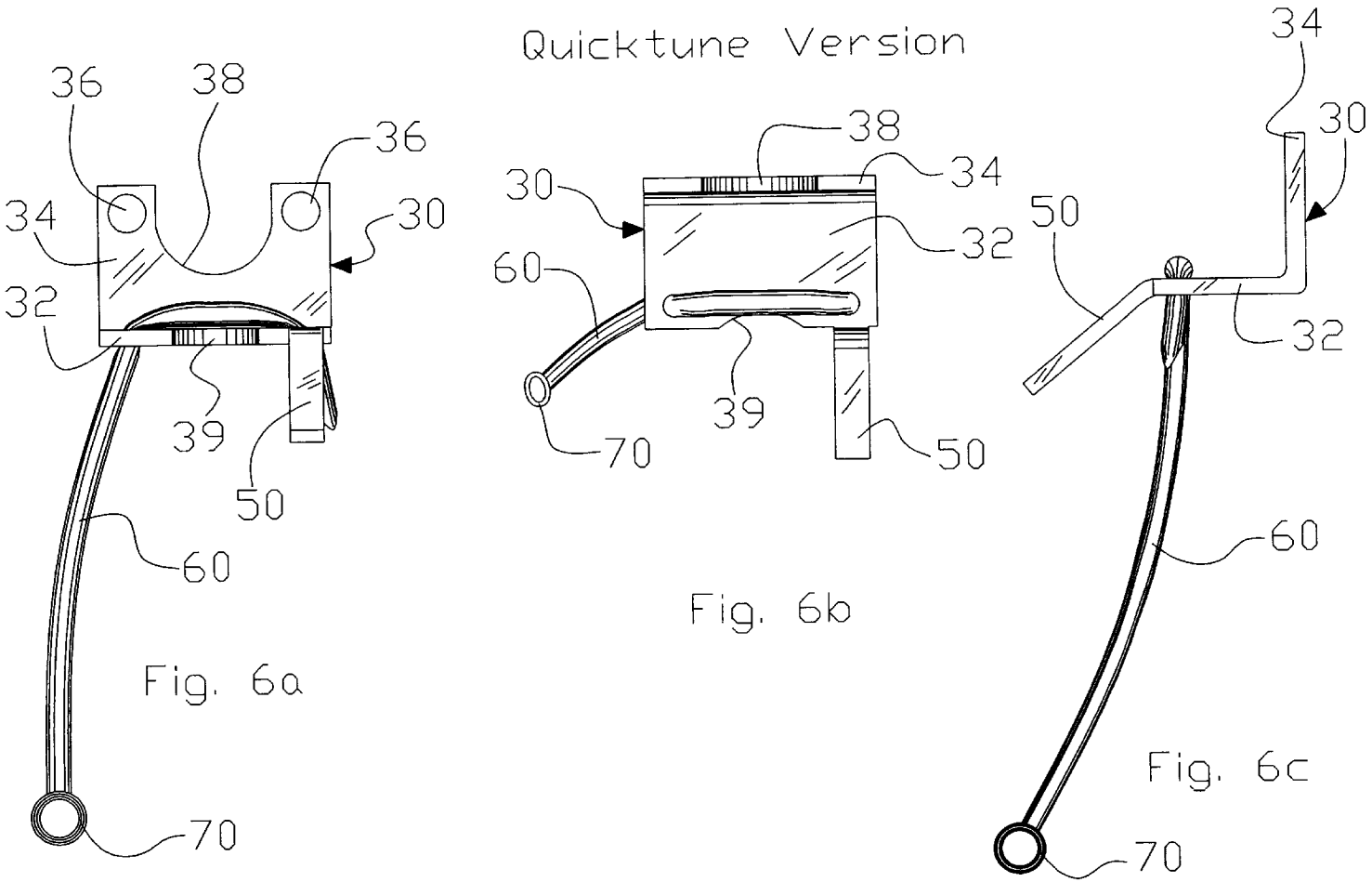
FIG. 6*a* is an upper view of the present invention designed for the QUIKTUNE support rest.
FIG. 6*b* is a front view of the present invention designed for the QUIKTUNE support rest.
FIG. 6*c* is a side view of the present invention designed for the QUIKTUNE support rest.

For example, if the base plate 30 is to be attached to a QUIKTUNE support rest 20, the base plate 30 would include a first portion 32 and a second portion 34 traverse to one another as illustrated in FIGS. 6*a* through 6*c* of the drawings. The second portion 34 preferably would include the apertures 36 along with a first cutout 38 that correspond to the main body of the QUIKTUNE support rest 20 as illustrated in FIG. 6*a* of the drawings. As shown in FIGS. 6*a* through 6*c* of the drawings, the securing strap 60 is attached to the first portion 32 of the base plate 30. In addition, the guide arm 50 extends at an angle from the first portion 32 as best illustrated in FIG. 6*c* of the drawings.

Figures 7A, 7B, 7C:
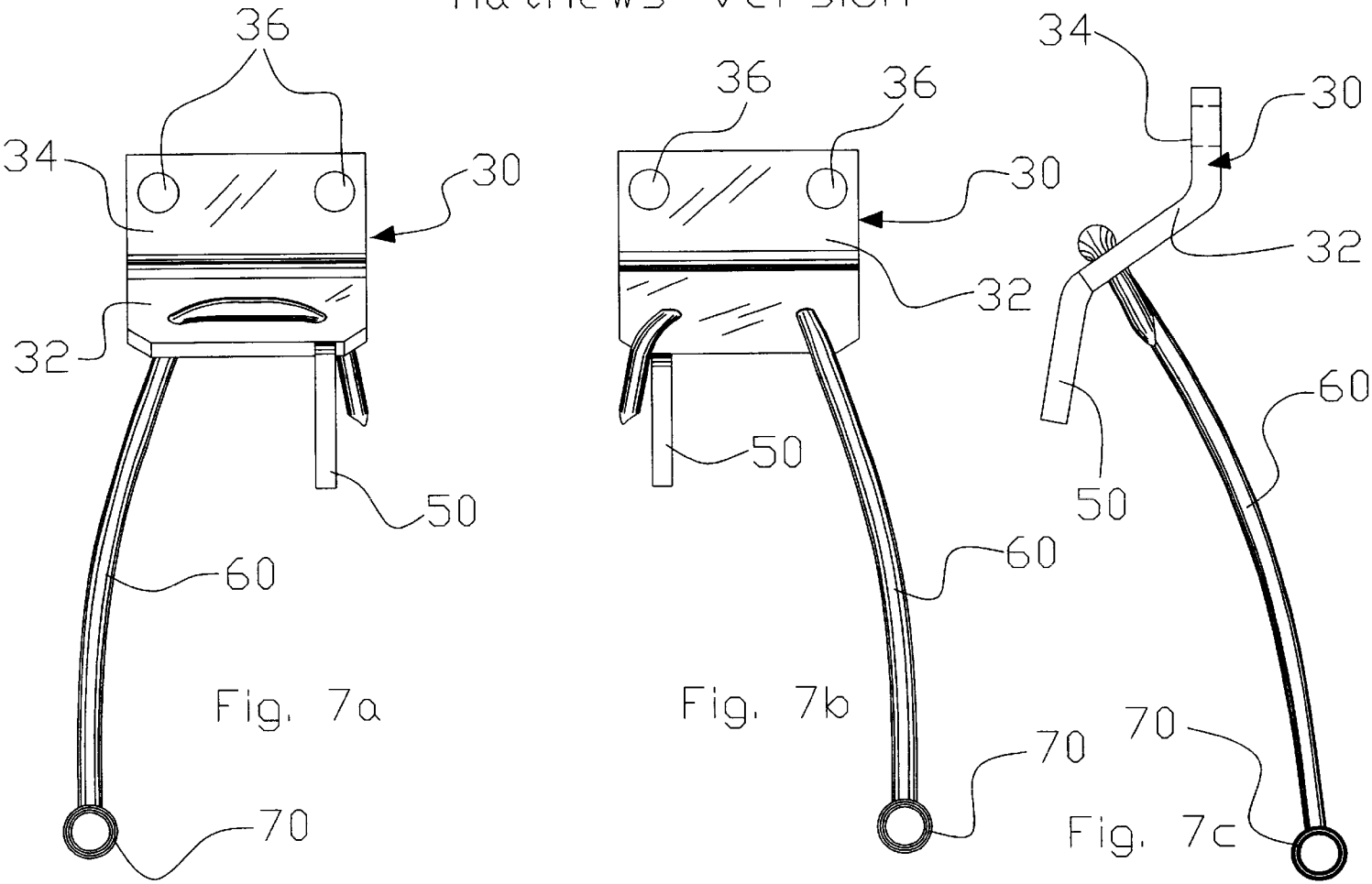
FIG. 7*a* is an upper view of the present invention designed for the MATHEWS support rest.
FIG. 7*b* is a front view of the present invention designed for the MATHEWS support rest.
FIG. 7*c* is a side view of the present invention designed for the MATHEWS support rest.

If the base plate 30 is to be attached to a MATHEWS support rest 20, the base plate 30 would include a first portion 32 and a second portion 34 at an angle with respect to one another as illustrated in FIGS. 7*a* through 7*c* of the drawings. The second portion 34 preferably would include the apertures 36 along with a first cutout 38 that correspond to the main body of the MATHEWS support rest 20 as illustrated in FIG. 7*a* of the drawings. As shown in FIGS. 7*a* through 7*c* of the drawings, the securing strap 60 is attached to the first portion 32 of the base plate 30. In addition, the guide arm 50 extends at an angle from the first portion 32 as best illustrated in FIG. 7*c* of the drawings as with the QUIKTUNE embodiment.

Figure 8A:
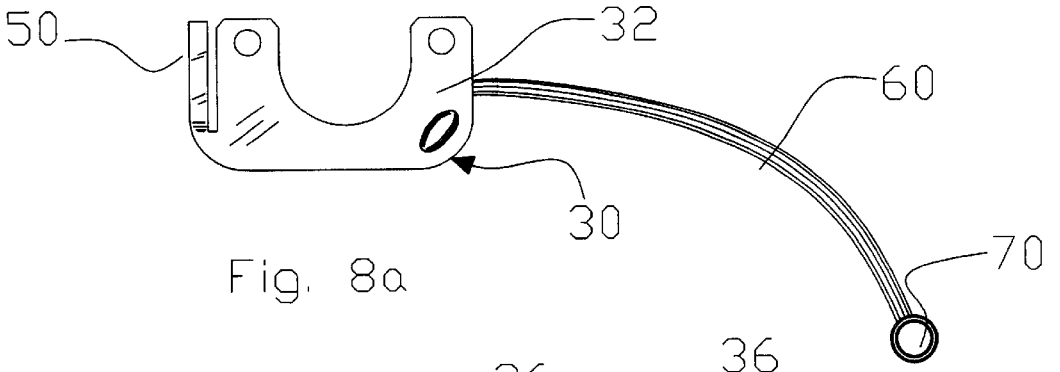
FIG. 8*a* is an upper view of the present invention designed for the BODOODLE support rest.
Figure 8B:
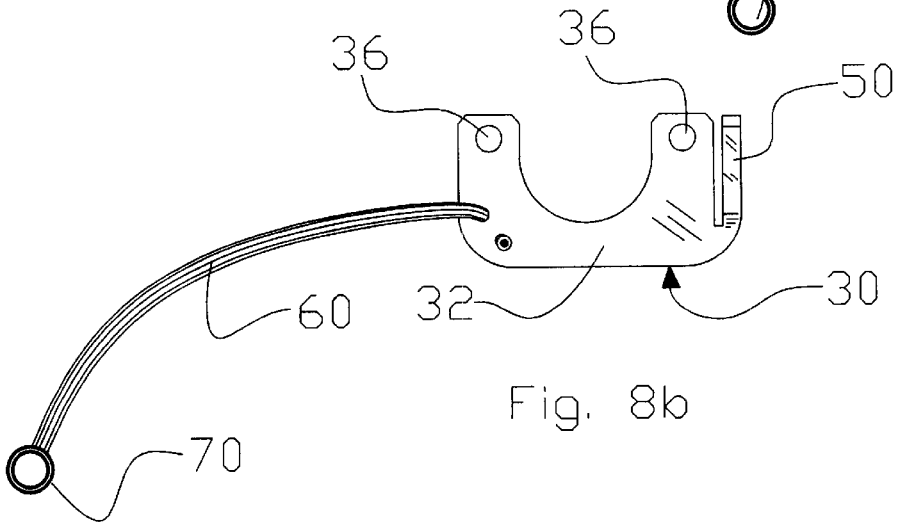
FIG. 8*b* is a front view of the present invention designed for the BODOODLE support rest.
Figure 8C:
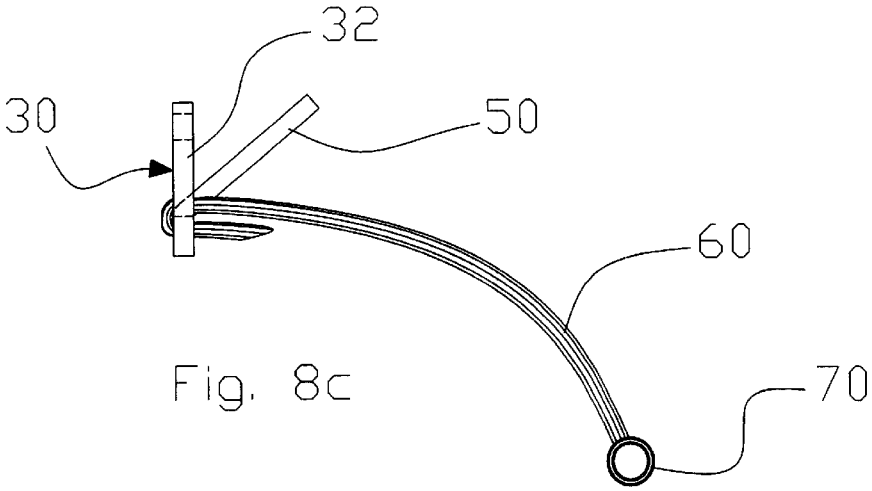
FIG. 8*c* is a side view of the present invention designed for the BODOODLE support rest.

If the base plate 30 is to be attached to a BODOODLE support rest 20, the base plate 30 would have only a first portion 32 as illustrated in FIGS. 8*a* through 8*c* of the drawings. The first portion 32 would include the apertures 36 along with a second cutout 39 that correspond to the main body of the BODOODLE support rest 20 as illustrated in FIG. 8*a* of the drawings. As shown in FIGS. 8*a* through 8*c* of the drawings, the securing strap 60 is attached to the first portion 32 of the base plate 30. In addition, the guide arm 50 extends at an angle from the first portion 32 as best illustrated in FIG. 8*c* of the drawings.

As can be appreciated, the base plate 30 may be modified in numerous configurations to fit properly upon the various support rests 20 on the market and should not be limited solely to the disclosure illustrated within the drawings. Further structures of the base plate 30 are deemed readily apparent to one skilled in the art and will not be discussed further.

As shown in FIGS. 1 through 8*c* of the drawings, the guide arm 50 extends from the first portion 32 of the base plate 30 at an angle. As illustrated in FIGS. 1 and 2 of the drawings, the guide arm 50 preferably extends rearwardly at a slight upward angle with respect to a horizontal plane defined by the longitudinal axis of the shaft 18. It can be appreciated that various angles may be utilized for the guide arm 50 to properly operate the present invention. The guide arm 50 is preferably a narrow 16 elongate structure as best illustrated in FIGS. 6*a* through 8*c* of the drawings.

As further shown in FIGS. 1 through 8*c* of the drawings, a length of securing strap 60 is attached to the base plate 30. It can be appreciated that the securing strap 60 may be attached to the base plate 30 in various configurations and methods other than shown in the drawings. The securing strap 60 is comprised of a stretchable material to provide a tight positioning about the shaft 18 of the arrow 16 to reduce movement of the arrow 16 with the support rest 20. The securing strap 60 is preferably constructed of but not limited to a rubber material such as silicone rubber. The securing strap 60 preferably has a frictionally gripping, non-slip characteristic to securely engage the shaft 18 of the arrow 16 during usage. The securing strap 60 may be comprised of either a solid structure or a tubular structure.

As best illustrated in FIGS. 4 through 8*c* of the drawings, a ring member 70 is attached to the distal end of the securing strap 60. The ring member 70 is preferably constructed of a relatively hard material such as plastic or metal. The ring member 70 is formed to slidably fit about the guide arm 50 as illustrated in FIGS. 1, 3 and 4 of the drawings. The ring member 70 is preferably circular shaped, however various other shapes may be utilized to construct the ring member 70.

In use, the user secures the base plate 30 to the main body of the support rest 20 as shown in FIGS. 1 through 5 of the drawings. The user then positions an arrow 16 with the shaft 18 positioned within the support arms 22 of the support rest 20 as shown in FIGS. 1 through 5 of the drawings. The user then grasps the distal portion of the securing strap 60 and stretches the securing strap 60 about the upper portion of the shaft 18 of the arrow 16 thereafter positioning the ring member 70 about the guide arm 50 as shown in FIGS. 1 and 3 of the drawings. The securing strap 60 is now gripping the upper portion of the shaft 18 of the arrow 16 thereby applying a downward force upon the arrow 16 which retains the arrow 16 within the support arms 22 of the support rest 20. When the user decides to shoot the arrow 16 from the bow 12, the user grasps the arrow 16 and draws the arrow 16 rearwardly thereby causing the securing strap 60 to correspondingly move rearwardly. The rearward movement of the securing strap 60 pulls the ring member 70 from the guide arm 50 until the ring member 70 is completely removed from the ring member 70 as illustrated in FIGS. 4 and 5 of the drawings. After the ring member 70 is completely released from the guide arm 50, the securing strap 60 swings over the shaft 18 of the arrow 16 to rest in a downward position without obstructing the path of the arrow 16 as illustrated in FIG. 2 of the drawings. The user continues to draw the arrow 16 rearwardly, aims and shoots the arrow 16 in the desired location without interference from the securing strap 60. The above process is simply repeated for the next arrow 16 to be shot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Arrow Holding Device

| | |
|---|---|
| ENVIRONMENTAL ELEMENTS | 40. Fasteners |
| | 41. |
| | 42. |
| | 43. |
| | 44. |
| | 45. |
| | 46. |
| | 47. |
| | 48. |
| | 49. |
| 10. Arrow Holding Device | 50. Guide Arm |
| 11. | 51. |
| 12. Bow | 52. |
| 13. Side Member | 53. |
| 14. Cable | 54. |
| 15. | 55. |
| 16. Arrow | 56. |
| 17. | 57. |
| 18. Shaft | 58. |
| 19. | 59. |
| 20. Support Rest | 60. Securing Strap |
| 21. | 61. |
| 22. Support Arms | 62. |
| 23. | 63. |
| 24. | 64. |
| 25. | 65. |
| 26. | 66. |
| 27. | 67. |
| 28. | 68. |
| 29. | 69. |
| 30. Base Plate | 70. Ring Member |
| 31. | 71. |
| 32. First Portion | 72. |
| 33. | 73. |
| 34. Second Portion | 74. |
| 35. | 75. |
| 36. Apertures | 76. |
| 37. | 77. |
| 38. First Cutout | 78. |
| 39. Second Cutout | 79. |

I claim:

1. An arrow holding device for selectively securing an arrow within a pair of support arms of a support rest, comprising:

a base plate attachable to the support rest;

a guide arm extending rearwardly from said base plate;

a securing strap attached to said base plate, wherein said securing strap is able to be positioned about a shaft of the arrow; and a ring member attached to said securing strap opposite of said base plate, wherein said ring member is slidably positionable upon said guide arm.

2. The arrow holding device of claim 1, wherein said securing strap is stretchable.

3. The arrow holding device of claim 1, wherein said guide arm extends from said base plate at an angle with respect to the shaft of the arrow.

4. The arrow holding device of claim 1, wherein said guide arm extends from said base plate at an angle toward the shaft of the arrow.

5. The arrow holding device of claim 1, wherein said securing strap is comprised of a rubber material.

6. The arrow holding device of claim 1, wherein said securing strap is comprised of a silicone rubber.

7. The arrow holding device of claim 1, wherein said securing strap is constructed of a tubular structure.

8. The arrow holding device of claim 1, wherein said ring member is a rigid structure.

9. The arrow holding device of claim 1, wherein said ring member is comprised of a material that easily slides upon said guide arm.

10. The arrow holding device of claim 1, wherein said base plate includes a plurality of apertures for receiving a plurality of fasteners that are threadably attached to the support rest.

11. An arrow holding device for selectively securing an arrow within a pair of support arms of a support rest, comprising:

a base plate having a first portion and a second portion, said second portion attachable to the support rest;

a guide arm extending rearwardly from said first portion of said base plate;

a securing strap attached to said base plate, wherein said securing strap is able to be positioned about a shaft of the arrow; and a ring member attached to said securing strap opposite of said base plate, wherein said ring member is slidably positionable upon said guide arm.

12. The arrow holding device of claim 11, wherein said securing strap is stretchable.

13. The arrow holding device of claim 11, wherein said guide arm extends from said base plate at an angle with respect to the shaft of the arrow.

14. The arrow holding device of claim 11, wherein said guide arm extends from said base plate at an angle toward the shaft of the arrow.

15. The arrow holding device of claim 11, wherein said securing strap is comprised of a rubber material.

16. The arrow holding device of claim 11, wherein said securing strap is comprised of a silicone rubber.

17. The arrow holding device of claim 11, wherein said securing strap is constructed of a tubular structure.

18. The arrow holding device of claim 11, wherein said ring member is a rigid structure.

19. The arrow holding device of claim 11, wherein said ring member is comprised of a material that easily slides upon said guide arm.

20. The arrow holding device of claim 11, wherein second portion of said base plate includes a plurality of apertures for receiving a plurality of fasteners that are threadably attached to the support rest.

* * * * *